US006461281B2

(12) United States Patent
Bouvier

(10) Patent No.: US 6,461,281 B2
(45) Date of Patent: Oct. 8, 2002

(54) KICK BAG FOR PHYSICAL THERAPY

(76) Inventor: Ronald O. Bouvier, 67 Pavers Mill Rd., Phillipston, MA (US) 01331

( * ) Notice: Subject to any disclaimer, the term of this patent is extended or adjusted under 35 U.S.C. 154(b) by 0 days.

(21) Appl. No.: 09/764,002

(22) Filed: Jan. 17, 2001

(65) Prior Publication Data

US 2002/0010057 A1 Jan. 24, 2002

Related U.S. Application Data

(60) Provisional application No. 60/217,267, filed on Jul. 11, 2000.

(51) Int. Cl.[7] ..... A63B 69/34
(52) U.S. Cl. ..... 482/86; 482/83; 482/87
(58) Field of Search ..... 482/83–90; 473/441, 473/445

(56) References Cited

U.S. PATENT DOCUMENTS

| | | | | | |
|---|---|---|---|---|---|
| 474,760 | A | * | 5/1892 | Peterson | 482/86 |
| 4,103,889 | A | * | 8/1978 | Lobur | 482/83 |
| 4,208,048 | A | * | 6/1980 | Winterbottom | 482/83 |
| 6,244,993 | B1 | * | 6/2001 | Dunn | 482/83 |

* cited by examiner

*Primary Examiner*—Jerome Donnelly
(74) *Attorney, Agent, or Firm*—Blodgett & Blodgett, P.C.

(57) ABSTRACT

A striking bag assembly which includes a primary bag suspended from a fixed support and an anchor bag suspended from the primary bag. The anchor bag is smaller and heavier and, therefore, considerably denser than the primary bag. More specifically, the anchor bag is pivotally connected to the primary bag and the primary bag is pivotally connected to the fixed support.

7 Claims, 1 Drawing Sheet

KICK BAG FOR PHYSICAL THERAPY

CROSS-REFERENCE TO RELATED APPLICATIONS

This application claims the benefit under 35 U.S.C. §119 (e) of prior U.S. Provisional application No. 60/217,267 filed Jul. 11, 2000; all of which is hereby incorporated by reference.

STATEMENT REGARDING FEDERALLY SPONSORED RESEARCH OR DEVELOPMENT

This invention has been created without the sponsorship or funding of any federally sponsored research or development program.

BACKGROUND OF THE INVENTION

The present invention is directed to a striking bag or kick bag for physical training. The physical training can be for activities such as boxing, martial arts, aerobics, or as part of an overall physical fitness program. The bag is not limited to kicking and may be punched as in the case of training by a boxer.

Kick bags are relatively heavy as compared to "punching bags" which are most often associated with boxing. For this reason, kick bags are frequently referred to as "heavy bags", and range from 25 pounds to 100 pounds. Most kick bags are suspended from a fixed support and swing when kicked. The weight of the bag provides resistance to kicking and, therefore, promotes timing and strengthening of the muscles involved in delivering a kick. Kick bags are a popular and widely used training tool for a wide range of physical activities.

Despite their popularity, suspended kick bags have certain limitation. In order to provide resistance to kicking, the kick bag must be relatively heavy and, due to space restrictions, must also be relatively dense. Bag densities range from 7 pounds to 11 pounds per cubic foot. Although kick bags are filled with a compressible material, the impact resistance of the kick bags can be detrimental to the joints of young or untrained users and cannot be used as part of any rehabilitation exercise. In spite of this resistance to impact, highly skilled and conditioned kickers can deliver a kicking blow with such timing and force to cause even the heaviest bag to swing a substantial amount. In a sense, this provides positive feedback to the kicker. However, the kicker must wait for the bag to "settle down" or "catch" the bag to stop it from swinging. The efforts to "settle" the kick bag interferes with the user's workout. One solution to this problem is to have another person stand behind the bag to prevent it from swinging. The need to have another person involved is a very limiting factor. If the kickers work as a pair, their own workouts are cut in half time-wise.

The problems associated with the swinging of the suspended kick bag are avoided by free standing kick bags. This type of kick bag is mounted on a base filled with sand or water. The bag and base assembly weighs between 150 pounds and 275 pounds. The high weight of this type of kick bag makes it difficult to move and may be too heavy for some individuals to move. These and other difficulties experienced with the prior art kick bags have been obviated by the present invention.

It is, therefore, a principal object of the present invention to provide a suspended striking bag or kick bag which avoids all of the problems of prior art suspended kick bags.

Another object of the invention is the provision of a suspended striking bag which provides a low impact to kicking and is highly resistant to swinging from kicks.

A further object of the invention is the provision of a suspended striking bag that is lighter than prior art suspended striking bags or kick bags of comparable size and provides greater resistance to kicking than said prior art kick bags.

Another object of the present invention is the provision of a suspended striking bag which is easy to use and store.

BRIEF SUMMARY OF THE INVENTION

In general, the invention consists of a kick bag or striking bag assembly which includes a primary bag adapted to be suspended from a fixed support and an anchor bag suspended from the primary bag. The anchor bag is smaller and heavier and, therefore, considerably denser than the primary bag. More specifically, the anchor bag is pivotally connected to the primary bag and the primary bag is pivotally connected to the fixed support.

BRIEF DESCRIPTION OF THE DRAWINGS

The character of the invention, however, may be best understood by reference to one of its structural forms, as illustrated by the accompanying drawings in which.

DETAILED DESCRIPTION OF THE INVENTION

Figure 1:
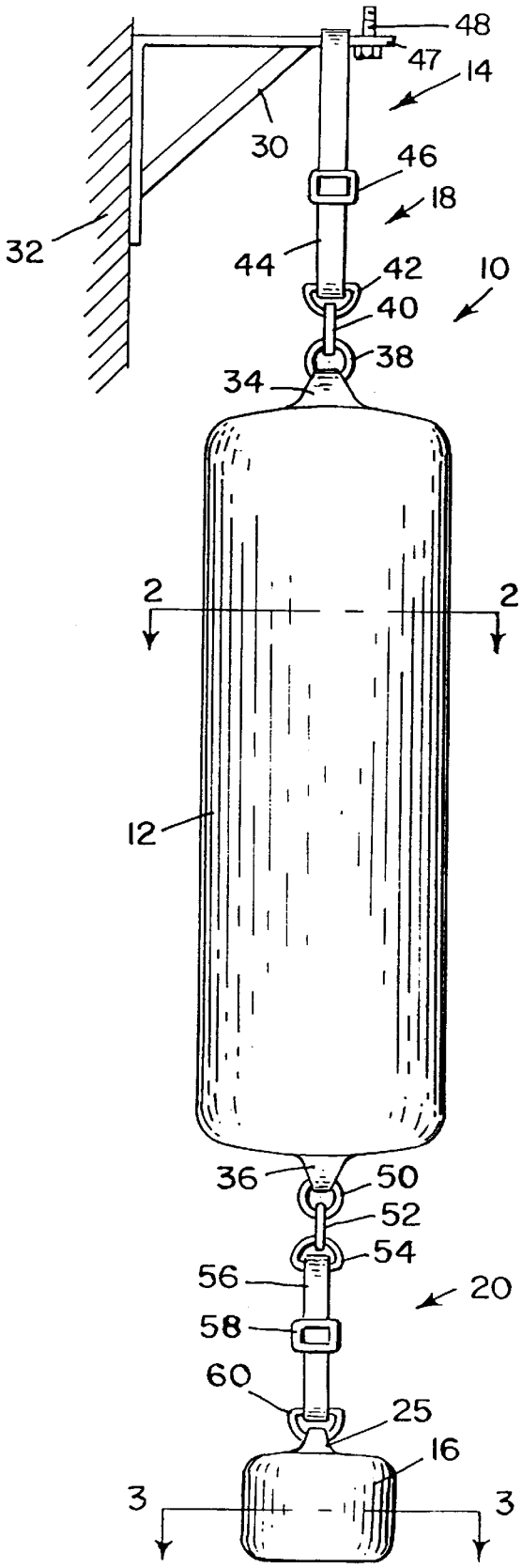
FIG. 1 is a side elevational view of a striking bag assembly embodying the principles of the present invention.
Figure 2:
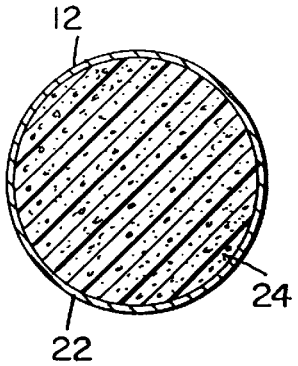
FIG. 2 is a horizontal cross-sectional view of the primary bag portion of the striking bag assembly taken along line 2—2 of FIG. 1 and looking in the direction of the arrows.
Figure 3:
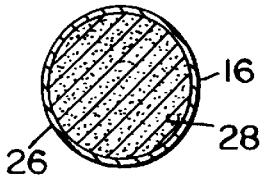
FIG. 3 is a horizontal cross-sectional view of the anchor bag portion of the striking bag assembly taken along line 3—3 of FIG. 1 and looking in the direction of the arrows.

Referring to the drawings, the striking bag assembly of the present invention is generally indicated by the reference numeral 10 and includes a primary bag 12 adapted to be suspended from a fixed support, generally indicated by the reference numeral 14 and an anchor bag 16 suspended from the primary bag 12 by means of a lower suspension system, generally indicated by the reference numeral 12. The primary bag 12 has an elongated cylindrical shape and is composed of a soft resiliently compressible material such as foam plastic 24 enclosed within a casing, or cover 22 of a pliable material such as leather or vinyl. The upper end of the casing 22 has an upper loop 34. The lower end of the casing 22 has a lower loop 36. The anchor bag 16 comprises a cover, or casing 26 of a pliable material such as leather or vinyl containing a relatively heavy granular material such as sand 28. The upper end of the casing 26 has a loop 25.

The fixed support 14 includes a rigid bracket 30 attached to a fixed structure 32 such as a wall or beam. The upper suspension system 18 comprises a heavy duty flexible strap 44 supported on the bracket 30 the strap 44 is looped over a horizontally extending portion 47 of the bracket 30. The strap 44 is prevented from sliding off the portion 47 by a stop such as a bolt 48. The strap 44 can also be fixed to the portion 47 by a fastener. One end of the strap 44 is fixed to a buckle 46. The other end of the strap 44 is looped through a ring 42 and then extended through the buckle 46 to enable the effective length of the strap 44 to be adjusted. The upper loop 34 of the casing 22 is looped through a ring 38. An intermediate ring 40 is looped through the ring 38 and the ring 42. The rings 38, 40 and 42 provide a universal swing connection which enables the primary bag 12 to swing in any direction, regardless at which point the primary bag is struck.

The lower suspension system 20 includes a heavy duty flexible strap 56. One end of the strap 56 is fixed to a buckle 58. The other end of the strap 56 is looped around a ring 60, then through a ring 54 and through the buckle 58 to enable the effective length of the strap 56 to be adjusted. The loop 25 of the anchor bag 16 is looped around the ring 60. The lower loop 36 of the primary bag 12 is looped around a ring 50. An intermediate ring 52 is looped around rings 50 and 54. The arrangement of rings 50, 52 and 54 enable the anchor bag 16 to swing in any direction from the lower end of the primary bag 12.

The anchor bag 16 is considerably smaller and preferably heavier than the primary bag 12 and therefore, considerably denser than the primary bag 12. The anchor bag 16 is at least as heavy as the primary bag 12 and can be twice as heavy as the striking bag portion 12. The ideal condition is to have an anchor bag 16 which is from 33 per cent to 50 per cent heavier than the primary bag 12. The density of the anchor bag 16 can be from 30 times to 60 times that of the primary bag 12, 40 times being ideal. The actual density of the primary bag 12 can be from 1.5 pounds per cubic foot to 3.0 pounds per cubic foot, 2.5 pounds per cubic foot being ideal. This is in contrast to the density of "heavy" kick bags which range from 6 to 11 pounds per cubic foot. Therefore, the primary bag 12 provides a relatively soft, resiliently deformable surface which has low surface impact resistance to kicking or striking with the fist regardless of how hard the primary bag 12 is struck. In spite of its lightness, the primary bag 12 is prevented from swinging to any significant degree from its support by the anchor bag 16. Examples of primary bag and anchor bag combinations which are near the ideal are: 1.) a junior primary bag which is 36 inches long, has a diameter of 12 inches and weighs 6 pounds uses with an anchor bag which has a diameter of 6 inches, is 5 inches long and weighs 8 pounds, and 2.) an adult primary bag 42 long, a diameter of 14 inches and weighs 10 pounds used with an anchor bag 6 inches long, a diameter of 7.5 inches and weighs 15 pounds.

When the primary bag 12 is struck by a kick or a punch, the lower part of the primary bag 12 is prevented from swinging very far from its suspension system 18, due to the restraining affect of the anchor bag portion 16. Energy from the kick or punch is eventually transferred to the anchor bag 16. However, since the anchor bag 16 is suspended from the primary bag 12 by the swivel type lower suspension system 20, there is a delay in the movement of the anchor bag 16. A significant portion of the energy from the strike is used to overcome the resting inertia of the anchor bag 16. When the anchor bag 16 does move away from the kicker, the striking bag portion 12 is returning toward the kicker. Therefore, the motions of the primary bag 12 and anchor bag 16 are in opposite directions and quickly cancel each other out. Not only is the primary bag 12 prevented from moving very far from the initial strike of the kicker due to the affect of the anchor bag portion 16 but it returns to its initial vertical suspended position very quickly after a blow has been delivered to the primary bag. The elastic straps 44 and 56 also absorb some of the striking force to the primary bag 12 and add to the dampening affect provided by the anchor bag 16.

The primary bag can also be an air filled bladder. The outer casing is a relatively heavy air impervious material such as rubber or other elastomeric material. However, the overall weight of the air filled bladder is somewhat less than that of the primary bag 12 which is filled with foam plastic.

The invention having been thus described, what is claimed as new and desired to secure by Letters Patent is:

1. A striking bag assembly comprising:

(a) a primary bag adapted to be suspended from a fixed support for swinging motion relative to said fixed support when said primary bag is subjected to a horizontal force, said primary bag having a pliable casing and filled with a resiliently compressible first material which enables the primary bag to be safely struck by a person, and (b) an anchor bag suspended from said primary bag and having a substantially smaller volume than that of said primary bag, said anchor bag having a casing and filled with a second material which is substantially denser than said first matter, the weight of said anchor bag being from 100% to 200% of the weight of said primary bag.

2. The striking bag as recited in claim 1, wherein said first material is foam plastic and second material is sand.

3. The striking bag as recited in claim 1, wherein said first material is air and said casing is an air impervious material.

4. A striking bag assembly comprising;

(a) a primary bag adapted to be suspended from a fixed support for swinging motion relative to said fixed support wherein said primary bag is subjected to a horizontal force, said primary bag having a pliable air impervious casing and filled with air which enables the primary bag to be safely struck by a person, and (b) anchor bag suspended from said primary bag and having substantially smaller volume than that of said primary bag, said anchor bag having a casing and weighs more than said primary bag.

5. A striking bag assembly comprising:

(a) a primary bag adapted to be suspended from a fixed support for swinging motion relative to said fixed support when said primary bag is subjected to a horizontal force, said primary bag having a pliable air impervious casing and filled with air which enables the primary bag to be safely struck by a person, and (b) an anchor bag suspended from said primary bag and having a substantially smaller volume than that of said primary bag, and weighs at least 33% more than said primary bag.

6. A striking bag assembly as recited in claim 5, wherein said primary bag has an air impervious casing and said primary bag is filled with air.

7. A striking bag assembly as recited in claim 6, wherein said anchor bag is filled with sand.

* * * * *